United States Patent [19]

Chalmers, II

[11] Patent Number: 4,499,676

[45] Date of Patent: Feb. 19, 1985

[54] SKI BOOT

[75] Inventor: Edward L. Chalmers, II, Boulder, Colo.

[73] Assignee: Lange International S.A., Fribourg, Switzerland

[21] Appl. No.: 446,371

[22] Filed: Dec. 2, 1982

[30] Foreign Application Priority Data

Feb. 18, 1982 [CH] Switzerland ..... 1018/82

[51] Int. Cl.[3] ..... A43B 5/04; A43B 5/16

[52] U.S. Cl. ..... 36/120; 36/117; 36/125

[58] Field of Search ..... 36/121, 117, 120, 125

[56] References Cited

U.S. PATENT DOCUMENTS

| | | | |
|---|---|---|---|
| 3,405,463 | 10/1968 | Werner | 36/121 |
| 3,521,385 | 7/1970 | Dalebout | 36/120 |
| 3,543,421 | 2/1970 | Ader | 36/121 |
| 3,570,148 | 3/1971 | Morgan | 36/121 |
| 3,619,914 | 11/1971 | Hanson et al. | 36/121 |
| 3,633,291 | 1/1972 | Caporicci | 36/121 |
| 3,885,329 | 5/1975 | French | 36/120 |
| 4,096,651 | 6/1978 | Ancker | 36/120 |
| 4,349,971 | 9/1982 | Everest | 36/121 |
| 4,404,758 | 9/1983 | Kopp | 36/121 |

FOREIGN PATENT DOCUMENTS

| | | | |
|---|---|---|---|
| 2732522 | 1/1978 | Fed. Rep. of Germany . | |
| 2262453 | 2/1982 | Fed. Rep. of Germany . | |
| 2454767 | 12/1980 | France | 36/117 |
| 549970 | 6/1974 | Switzerland . | |

*Primary Examiner*—Henry S. Jaudon
*Assistant Examiner*—Mary A. Ellis
*Attorney, Agent, or Firm*—Brumbaugh, Graves, Donohue & Raymond

[57] ABSTRACT

This ski boot comprises a member for locking the upper in relation to the lower portion of the boot in the downhill running position, in the form of a rocker pivoted to a transverse axis in a cavity formed in the pivoted upper of the boot, and adapted to cooperate with a stop carried by the lower portion of the boot. The rocker can be released from the stop for straightening the skier's leg to a walking or non-skiing position by simply depressing the upper portion of the rocker. When the skier bends his leg the rocker is restored automatically to its locked position by a spring.

8 Claims, 3 Drawing Figures

SKI BOOT

BACKGROUND OF THE INVENTION

The present invention relates to a ski boor consisting of at least one lower portion or section comprising the sole and the counter, and of an upper pivotally mounted to this lower portion and incorporating a recessed member pivoted about a horizontal axis in a cavity formed at the rear of the upper, this member being adapted to be set in two positions, namely a first position in which its lower portion abutes a stop rigid with the upper portion of the boot so as to lock the upper in a position inclined towards the boot toe, and a second position in which the top of the upper is somewhat spaced from the boot and can swing slightly about this position. The locked condition of the upper is the normal skiing position in which the upper is propiciously inclined forward and relatively rigid, whereas the released position is available outside the ski practice for taking off the boot or walking with or without the skis, the free oscillation of the upper in relation to the lower portion of the boot permitting the natural movement of the lower portion of the leg with respect to the foot.

THE PRIOR ART

Various means for locking the upper in its inclined position or for releasing the upper from this position have already been proposed in the art, notably through the Swiss Pat. No. 549,970. Such means consist of a slider having its lower end secured to the lower portion of the boot and movable in a slideway secured to the boot upper, the slider being held in the slideway by the two bent end portions of a resilient strap pivotally mounted to the slideway. However, this device is rather complicated, heavy and cumbersome. Moreover, the resilient strap is obviously liable to be caught accidentally.

Another known and very simple device of this character consists of a small bar having its upper end pivoted in a recess formed in the upper and its lower end adapted to engage a stop rigid with the lower portion of the boot when the bar is nested into the recess. This bar is provided with a thumb piece for facilitating its removal from the stop and therefore permitting the straightening movement of the boot upper. to switch from the inoperative or walking position to the locked or skiing position, the user must simultaneously bend the leg and push the bar manually into its recess, which is a rather awkward procedure.

SUMMARY OF THE INVENTION

It is the essential purpose of the present invention to provide a device as simple as the last mentioned device but more convenient in use and free of any protruding element.

In the ski boot according to this invention the locking member proper consists of a rocker fulcrumed about a pivot axis extending across the cut-away portion of the upper intermediate its ends and associated with a spring constantly urging the lower portion of the rocker towards the boot, the upper portion of this rocker being shaped to constitute a push-in key. With this arrangement it is possible to release the upper by simply depressing this key, and on the other hand the upper is locked automatically under the spring force when the skier bends the leg in preparation of a downhill run.

Moreover, the rocker fits perfectly in the boot, without any projecting part.

DESCRIPTION OF THE PREFERRED EMBODIMENT

Figure 1:
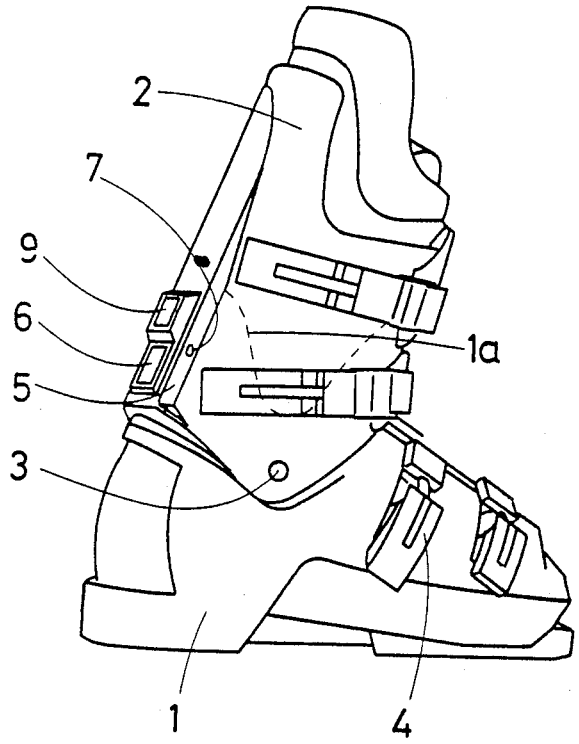
FIG. 1 is a diagrammatic perspective view showing a ski boot equipped with the locking device of the present invention.

The ski boot shown in FIG. 1 is molded from a suitable plastic composition and comprises in a manner known per se a lower portion 1 including the sole and the counter, and an upper portion or upper 2 pivoted to the lower portion 1 by means of a pair of pivot-forming rivets 3 of which only one is visible in the Figure, the other rivet being disposed on the inner side of the upper. The upper edge 1*a* of the lower portion 1 is amply surrounded by the upper at the front and back, as shown. To close the boot the latter is provided in the known fashion with four fasteners 4. The back of the upper has a relatively wide rib 5 formed thereon which extends from top to bottom of the upper and comprises a rectangular cavity in which a locking member 6 consisting of a rocker is fitted and fulcrumed by means of a pivot pin 7 extending across the rib 5.

Figure 2:
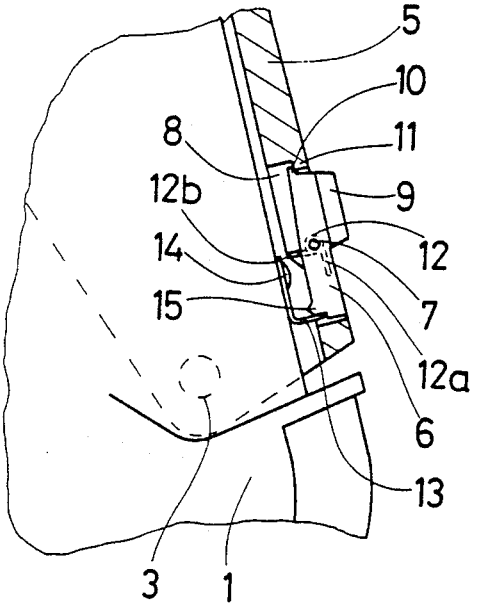
FIG. 2 is a detail view showing the upper in fragmentary section and the locking device in its upper locking position.

The cavity 8 in which the locking member 6 is fitted is shown in section in FIG. 2 together with the rib 5. This rocker 6 comprises above the pivot pin 7 an upper portion 9 constituting a kind of key having a slightly concave outer surface. The upper end of the key comprises an upwardly projecting lip 10 adapted to abute a corresponding downwardly projecting lip 11 formed in the upper edge of cavity 8 for limiting the pivotal movement of rocker 6. Surrounding the pivot pin 7 is a torsion spring 12 housed in a lateral cavity of rocker 6 and having an upper end 12*a* adapted to react against the bottom of this cavity and another end 12*b* bent at right angles and bearing against the inner face of the upper 2, on the edge of cavity 8. This spring 12 constantly urges the rocker 6 in the clockwise direction, as seen in the Figures, i.e. so that its upper lip 10 bears against the lip 11 of rib 5. Registering with the rocker 6, and secured to the lower portion 1 of the boot, is a stop 13 consisting of a metal member bent at right angles and secured by means of a rivet 14. The function of this stop 13 is to hold the lower end of rocker 6, as shown in FIG. 2. The stop 13 actually engages a notch formed in the lower end of rocker 6 so that the lower end of said stop is covered by the rocker and consequently invisible from the outside. Just above this notch the rocker 6 comprises a transverse rib 15 of substantially dihedral configuration.

Figure 3:
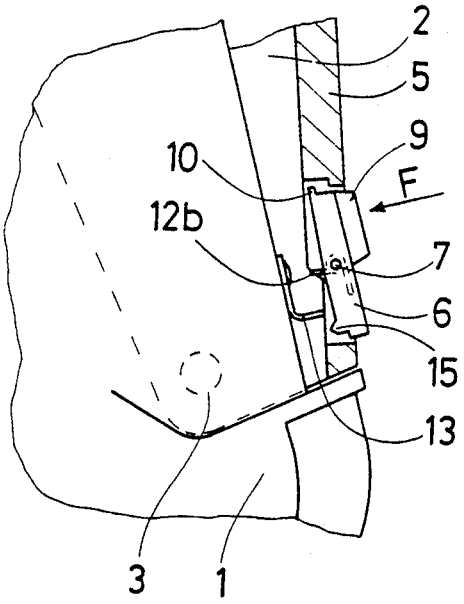
FIG. 3 is a view similar to FIG. 2 but showing the device in the release position.

From an initially forwardly inclined or downhill run position shown in FIG. 2, when the skier is desirous to take some rest and release the boot upper 2, he merely depresses the key 9 as shown by the arrow F of FIG. 3.

Thus, the rocker 6 is released from stop 13 and the skier can straighten his leg since the upper 2 can move freely to the position shown in FIG. 3. The outer concavity of key 9 facilitate this actuation and even permits of using the tip of a ski-stick for this purpose. When the skier releases the pressure exerted on key 9 the inner face of rocker 6 engages the end of stop 13 on which it can slide, if necessary, if the upper 2 oscillates about the pivot rivets 3. When the skier resumes his skiing position, i.e. bends the legs slightly, the stop 13 slides under the upper ramp of rib 5 while exerting a resilient pressure on rocker 6 so that the latter subsequently drops into its locked and abutment position shown in FIG. 2.

Of course, the above described construction may lend itself to many modifications and changes without departing from the basic principles of the invention, Thus, for instance, the stop 13 may be molded integrally with the lower portion 1 of the ski boot. On the other hand, the torsion spring 12 may be replaced by a compression spring disposed between the key 9 and the lower portion 1 of the boot. Furthermore, a simple rubber block may be substituted for this spring.

What is claimed is:

1. A ski boot comprising a boot lower, a boot upper pivotally mounted on the boot lower, a rocker pivotally mounted in a recess in the rear of the boot upper and adapted to be rotated between two positions, spring means urging rotation of said rocker on its pivot to the first of the two positions, a stop provided on the boot lower for engaging the rocker when it has been rotated to its first position, the rocker and stop cooperating to lock the boot upper against rearward movement of the boot lower when the boot upper is pivoted to a forward position, the rocker adapted to be manually urged against action of the spring means to the second position at which the stop is disengaged from the rocker, thereby unlocking the boot upper and permitting it to pivot rearwardly on the boot lower to facilitate standing and walking with the boot, and the rocker automatically being rotated to its first position by the spring means when the boot upper is pivoted forwardly in preparation for skiing to lock the boot upper in said forward position.

2. A ski boot as defined in claim 1, wherein the spring means comprises a torsion spring mounted on the rocker pivot.

3. A ski boot as defined in claim 1, wherein the rocker arm includes a concave portion readily actuatable manually.

4. A ski boot as defined in claim 1, wherein the rocker includes a notch to receive the stop on the boot lower.

5. A ski boot comprising a boot lower, a boot upper pivotally mounted on the boot lower, a rocker pivotally mounted in a recess in the rear of the boot upper and adapted to be rotated between two positions, spring means urging rotation of said rocker on its pivot to the first of the two positions, a stop provided on the boot lower for engaging the lower portion of the rocker when it has been rotated to its first position, the rocker and stop cooperating to lock the boot upper against rearward movement on the boot lower when the boot upper is pivoted to a forward position, the upper portion of the rocker adapted to be manually urged against action of the spring means to the second position at which the stop is disengaged from the lower portion of the rocker, thereby unlocking the boot upper and permitting it to pivot rearwardly on the boot lower to facilitate standing and walking with the boot, and the rocker automatically being rotated to its first position by the spring means when the boot upper is pivoted forwardly in preparation for skiing to lock the boot upper in said forward position.

6. A ski boot as defined in claim 5, wherein the spring means comprises a torsion spring mounted on the rocker pivot.

7. A ski boot as defined in claim 5, wherein the upper portion of the rocker arm includes a concave portion readily actuatable manually.

8. A ski boot as defined in claim 5, wherein the lower portion of the rocker includes a notch to receive the stop on the boot lower.

* * * * *

UNITED STATES PATENT AND TRADEMARK OFFICE

CERTIFICATE OF CORRECTION

PATENT NO. : 4,499,676

DATED : Feb. 19, 1985

INVENTOR(S) : Chalmers, II, et al.

It is certified that error appears in the above-identified patent and that said Letters Patent is hereby corrected as shown below:

On the title page, add:

David C. Everest III, of Boulder, Colorado

Signed and Sealed this

*Thirtieth* Day of *July 1985*

[SEAL]

*Attest:*

DONALD J. QUIGG

*Attesting Officer* *Acting Commissioner of Patents and Trademarks*